US005322159A

United States Patent [19]

Houlihan

[11] Patent Number: 5,322,159

[45] Date of Patent: Jun. 21, 1994

[54] HANGING DISPLAY IMPROVEMENT FOR NESTING CONTAINERS

[75] Inventor: John T. Houlihan, Southbury, Conn.

[73] Assignee: Timex Corporation, Middlebury, Conn.

[21] Appl. No.: 82,569

[22] Filed: Jun. 25, 1993

[51] Int. Cl.[5] ..... B65D 5/64

[52] U.S. Cl. ..... 206/45.2

[58] Field of Search ..... 206/45.2, 45.21, 45.22, 206/45.23

[56] References Cited

U.S. PATENT DOCUMENTS 804,725 11/1905 James ..... 206/45.2

2,790,542 4/1957 Hillman ..... 206/45.2

*Primary Examiner*—William I. Price

*Attorney, Agent, or Firm*—William C. Crutcher

[57] ABSTRACT

An improvement in a known type of display box having two complementary separable box halves arranged to display a wristwatch, comprising a rear box half of rigid material with a bottom wall, a rear wall and two spaced triangular side walls, a watch holder supported in the rear box half and adapted to display the wristwatch, and a front box half of rigid transparent material with a top wall, a front wall and two spaced substantially flat triangular side walls and adapted to nest with the rear box half. The improvement comprises a recessed pocket in the back of the rear box half, formed by a stepped construction in the rear wall and bottom wall, and a slot in the top wall of the front box half, the recess and the slot being so located as to cause the slot to be aligned with the recess when the box halves are nested, whereby the open box may be supported on a peg extending through the slot into the recess so as to display the wristwatch. The rear box half containing the watch may be removed temporarily, leaving the front box half hanging on the rack.

5 Claims, 3 Drawing Sheets

HANGING DISPLAY IMPROVEMENT FOR NESTING CONTAINERS

BACKGROUND OF THE INVENTION

This invention relates for containers for displaying sales objects, such as wristwatches, on racks in retail stores. More particularly, the invention relates to improvements in containers for wristwatches and the like which are adapted to separate into two complementary box halves.

Rack or counter displays for sales objects such as wristwatches, jewelry, and the like are arranged to hold and display the sales objects in their individual containers. Often the containers have a transparent flexible covering or a rigid transparent cover so that the sales object may be seen by the prospective purchaser without removing it from its container.

In order to get a better view of the sales object, there is a known type of nesting container, wherein the transparent cover may be removed and reversed so as to nest with the other container half, so that the sales object may be seen more clearly. While some display racks have shelves on which the container may rest, other display racks are adapted in various ways to hold the containers on hooks or pegs. Existing designs of nesting containers do not readily permit hanging the open containers from display racks.

Accordingly, one object of the present invention is to provide an improvement in a hanging display container for a sales object, such as a wristwatch.

Still another object of the invention is to provide an improved hanging display for nesting containers.

SUMMARY OF THE INVENTION

Briefly stated, the invention is an improvement in a known type of display box having two complementary separable box halves arranged to display a sales object, comprising a rear box half of rigid material with a bottom wall, a rear wall and two spaced triangular side walls, means supported in the rear box half and adapted to display a sales object, and a front box half of rigid transparent material with a top wall, a front wall and two spaced substantially flat triangular side walls and adapted to nest with the rear box half, the improvement comprising: at least one recess defined in the bottom wall of the rear box half, and at least one opening defined in the top wall of the front box half, the recess and the opening being so located as to cause the opening to be aligned with the recess when the box halves are nested, whereby the open box may be supported on a peg extending through the opening into the recess so as to display the sales object.

DRAWING

The subject matter, which is regarded as the invention, is particularly pointed out and distinctly claimed in the concluding portion of the specification. The invention, however, as to both organization and method of practice, together with further objects and advantages thereof, may best be understood by reference to the following description, taken in connection with the accompanying drawing, in which:

Figure 3:
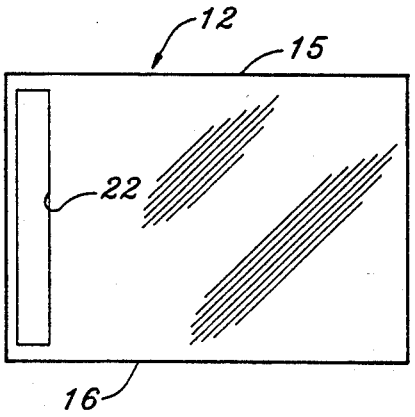
Figure 1:
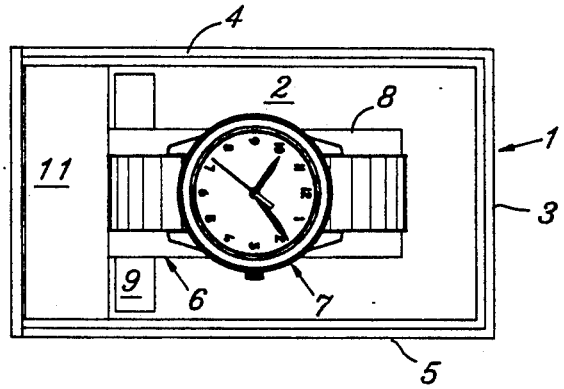
FIG. 1 is a top plan view of a rear box half adapted to hold a wristwatch.
Figure 4:
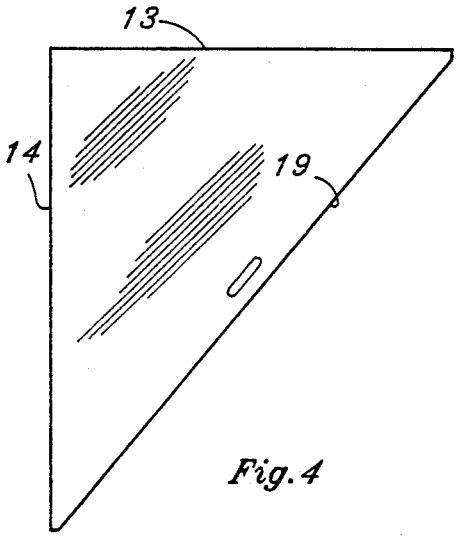
Figure 5:
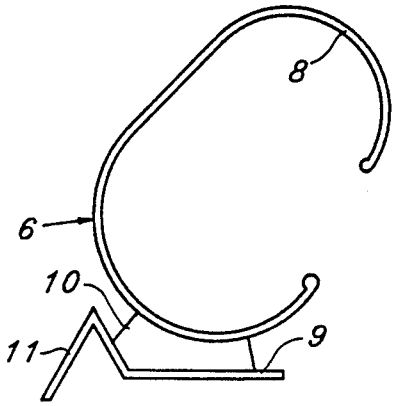
Figure 6:
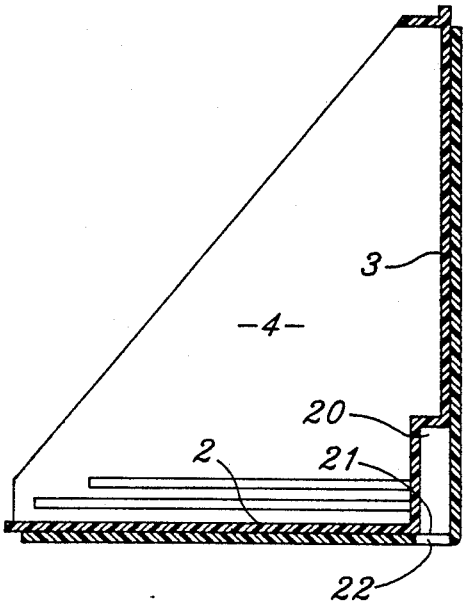
Figure 7:
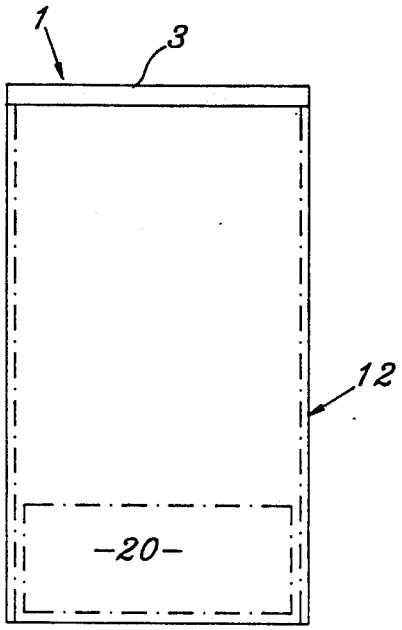
Figure 8:
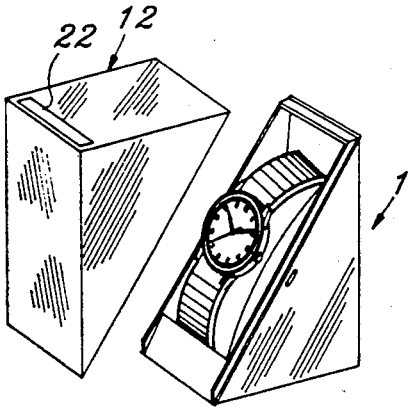
Figure 9:
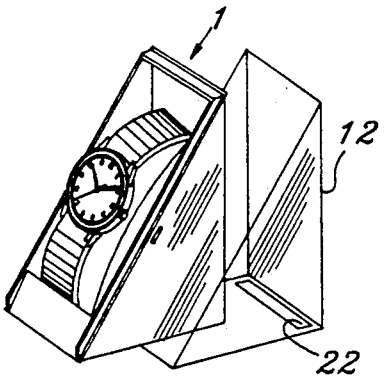
Figure 10:
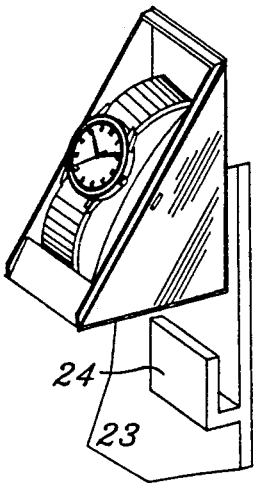
Figure 11:
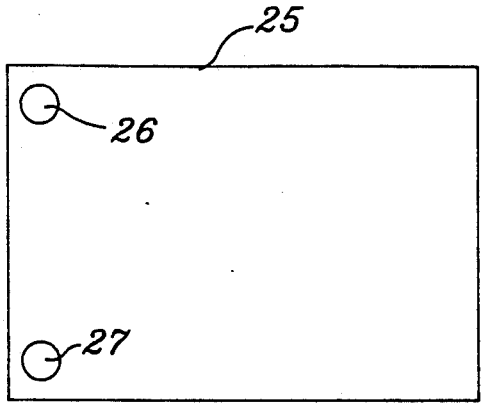
Figure 12:
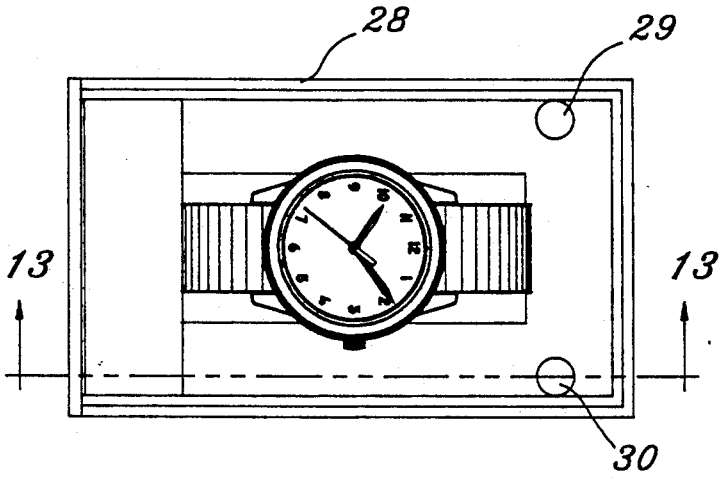
Figure 13:
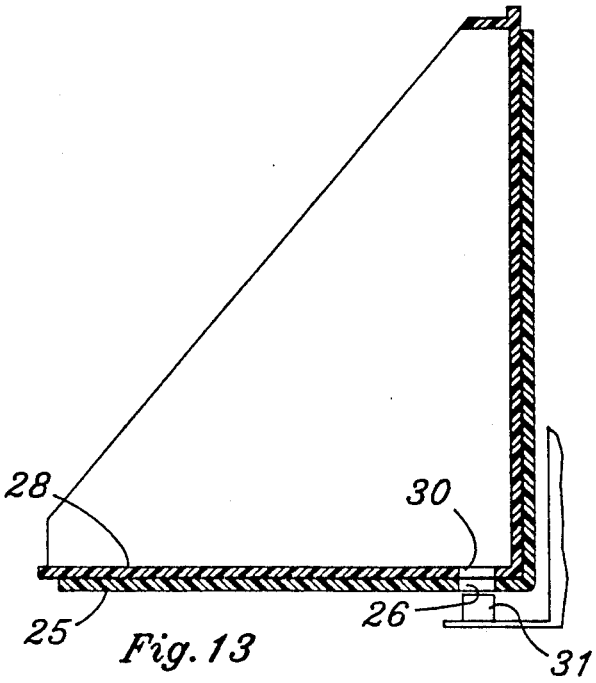

FIG. 3 is a top plan view of a front transparent box half adapted to cover the rear box half of FIG. 1, FIG. 4 is a side elevational view of the front box half of FIG. 3, FIG. 5 is a side elevational view of a C-clip holder for a wristwatch adapted to fit in the rear box half, FIG. 6 is a side elevational view and cross section showing nested rear and front box halves, FIG. 7 is a rear elevational drawing showing nested front and rear box halves, and FIGS. 8–10 are perspective views illustrating operation of the invention, FIG. 11 is a top plan view of a modified front transparent box, FIG. 12 is a top plan view of the rear half of the modified box, and FIG. 13 is a side elevational view and cross section taken on line 13—13 of FIG. 12.

DESCRIPTION OF THE PREFERRED EMBODIMENT

Figure 2:
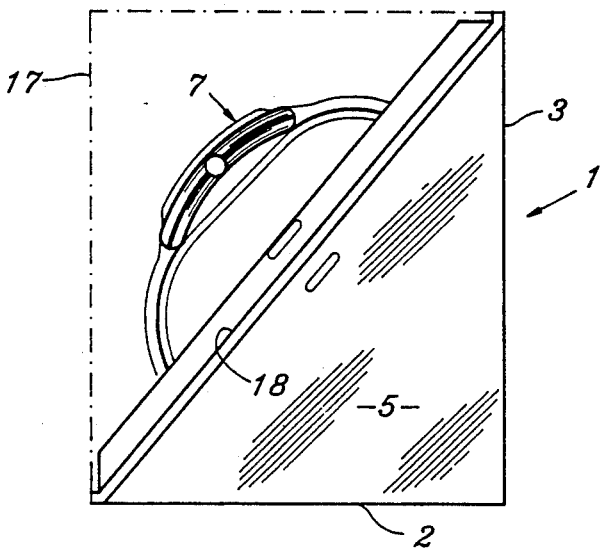
FIG. 2 is a side elevational view of the rear box half of FIG. 1.

Referring now to the drawings, the initial part of the description relates to a known type of nestable container. FIGS. 1 and 2 of the drawing illustrate plan and side elevation view respectively of the rear half of a watch box. The rear box half is comprised of rigid plastic material, usually opaque, shown generally as 1. Rear box half 1 comprises a bottom wall 2, a rear wall 3, and two spaced substantially flat triangular sidewalls 4, 5 all connected together to provide one-half of an enclosure. Disposed in rear box half 1 is an insert shown generally as 6 adapted to support a sales object, such as a wristwatch 7. The holding insert 6 may take various shapes depending upon the type of sales object. However, as shown in FIG. 5, it may comprise a C-clip consisting of a plastic molding of a springy C-shaped member 8 held on a base 9 by means of an integral rib 10. Base 9 may also include a brand name panel 11 which is displayed from the front of the box.

Referring to FIGS. 3 and 4 of the drawing, the other half of the container comprises a front box half shown generally as 12, comprised of rigid transparent plastic material. Front box half 12 includes a top wall 13, a front wall 14, and two spaced substantially flat triangular sidewalls 15, 16, all connected together to provide the other half of the enclosure. During shipment or when not on display, front box half 12 is placed in complementary relationship with rear box half 1. This position is indicated by the phantom lines 17 in FIG. 2. A diagonal rib 18 embossed in each sidewall of the rear box half 1 serves as a stop for the triangular edge 19 of the top box half 12.

All of the foregoing construction is well-known and even conventional for a nesting type container for a wristwatch.

In accordance with the present invention, the improvement lies in modification of the previously known and described nesting container as follows:

Referring to the cross-section of FIG. 6 of the drawing, it is seen that both the bottom wall 2 and rear wall 3 have been offset to provide a recess 20 in the back corner of the rear box half. Recess 20 has an open end 21 in the bottom wall of the rear box half.

Further modification comprises provision of a slot-shaped opening 22 in the top wall of the front box half 12. See also FIG. 3, which indicates the location of opening 22 near the front wall 14. Opening 22 and the recess 20 are so shaped and arranged that when the rear box half nests the front box half, the two are aligned with one another. Reference to FIG. 4 of the drawing shows that recess 20 extends the full width of the back wall 3.

OPERATION

Referring to FIGS. 8, 9 and 10 of the drawing, the operation is illustrated. FIG. 8 illustrates the box in its normal closed position as the front box side 12 is being removed from rear box half 1.

FIG. 9 illustrates reversal of the front box half and placement so as to nest the front box half with slot 22 now disposed on the bottom.

FIG. 10 illustrates a portion of a holding rack 23 with a single peg or prong 24, it being understood that many pegs 24 are provided as desired in order to hold several boxes. Peg 24 is adapted to pass through the slot 22 in the front box half 12 and pass through the aligned opening 21 into recess 20. Thus the nested container is supported on rack 23 so as to display the wristwatch without the necessity of viewing it through the front box half. The front half may be removed and then replaced, while the rear half remains hanging on the peg 24.

MODIFICATION

FIGS. 11, 12 and 13 illustrate a modified form of the invention. In the top wall of the front box half 25 shown in FIG. 11, a pair of openings 26, 27 are provided on either side. In the rear box half 28 shown in FIG. 12, a similar pair of recesses 29, 30 pass completely through the bottom wall. A hanging rack seen in FIG. 13 includes pegs 31 which pass through the openings 26, 27 and the aligned recesses 29, 30.

The invention offers the advantage of providing a simple means for hanging nestable containers. This allows the nestable container to be used either on a conventional shelf, or to be hung from pegs, so that the front half acts as a small shelf without substantial modification of the container shapes. Various equivalent locations of the openings in the front box half and rear box half are possible without departing from the spirit and scope of the invention. For example, more than one opening in the top wall of the front box half may be provided to register with more than one opening in the bottom wall of the rear box half. Also, the recesses in the rear box half may pass through the bottom wall completely. Although the arrangement is shown where the sales object is a wristwatch, other items of jewelry or consumer sales objects are able to use the same type of improved container.

While there has been disclosed herein what is considered to be the preferred embodiment of the invention, other modifications may occur to those skilled in the art, and it is intended to cover in the appended claims all such modifications as fall within the true spirit and scope of the invention.

I claim:

1. Improvement in a box having two complementary separable box halves arranged to display a sales object, together with other boxes on a display rack having support pegs, said box comprising a rear box half of rigid material having a bottom wall, a rear wall and two spaced, substantially flat triangular sidewalls all connected together to provided one half of an enclosure, insert means supported in said rear box half and adapted to display said sales object, and a front box half of rigid transparent material having a top wall, a front wall and two spaced substantially flat triangular sidewalls, said front box half being substantially similar but slightly larger in width so as to nest said rear box half from the rear, said improvement comprising:

at least one recess defined in the rear box half and accessible from the bottom wall of said rear box half, and at least one opening defined in the top wall of said front box half, said recess and said opening being so located as to cause said opening to be aligned with said recess when the box halves are nested, whereby the nested box halves may be supported on a display rack support peg extending though said opening into said recess.

2. The improvement according to claim 1, wherein said recess comprises a step in the rear wall of said rear box half and a step in the bottom wall of said rear box half, thereby forming an open pocket defined by said stepped rear wall and bottom wall, whereby the front box half may be temporarily removed from the rear box half which remains supported on said rack.

3. The improvement according to claim 1 wherein said opening comprises an elongated slot through the top wall of said front box half adjacent said front wall thereof.

4. The improvement according the claim 1 wherein said recess comprises an opening completely through the bottom wall of said rear box half.

5. The improvement according the claim 1, wherein said sales object is a wristwatch and wherein said insert means is a removable C-clip.

* * * * *